US005218904A

United States Patent [19]

Loveland

[11] Patent Number: 5,218,904

[45] Date of Patent: Jun. 15, 1993

[54] MANUAL REFUSE COMPACTOR APPARATUS HAVING PARALLEL CRUSHING PLATENS

[76] Inventor: Leland C. Loveland, 7025 SW. Hoodview Pl., Beaverton, Oreg. 97005

[21] Appl. No.: 996,521

[22] Filed: Dec. 23, 1992

Related U.S. Application Data

[63] Continuation of Ser. No. 788,251, Nov. 5, 1991, abandoned.

[51] Int. Cl.[5] ..... B30B 1/04

[52] U.S. Cl. ..... 100/214; 100/266; 100/295

[58] Field of Search ..... 100/214, 266, 268, 295, 100/245, 255

[56] References Cited

U.S. PATENT DOCUMENTS

| | | | |
|---|---|---|---|
| 327,297 | 9/1885 | McGovern | 100/214 |
| 411,758 | 9/1889 | Campbell et al. | 100/268 |
| 697,287 | 4/1902 | Spaulding | 100/266 |
| 2,236,460 | 3/1941 | Thomas | 100/268 |
| 2,332,318 | 10/1943 | Hughes | 100/266 |
| 4,212,242 | 7/1980 | Willis | 100/233 |
| 4,257,321 | 3/1981 | Wheeler et al. | 100/268 |
| 4,333,397 | 6/1982 | Modes | 100/233 |
| 4,561,351 | 12/1985 | Ader | 100/233 |
| 4,606,266 | 8/1986 | Hyman, Sr. | 100/233 |

FOREIGN PATENT DOCUMENTS

| | | | |
|---|---|---|---|
| 0002885 | 10/1892 | Switzerland | 100/268 |
| 0008898 | of 1892 | United Kingdom | 100/266 |
| 0129561 | 7/1919 | United Kingdom | 100/268 |

*Primary Examiner*—Harvey C. Hornsby
*Assistant Examiner*—Reginald L. Alexander
*Attorney, Agent, or Firm*—John R. Flanagan

[57] ABSTRACT

A manually-operated refuse compactor apparatus includes a lower platen and an upper platen extending generally parallel to and spaced above the lower platen, a frame structure stationarily supporting the lower platen and positioning the upper platen in alignment above the lower platen, and a pair of yieldable reciprocal support mechanisms attached to the frame structure and yieldably supporting the upper platen from the frame structure for undergoing reciprocal rectilinear movement toward and away from the lower platen for crushing items between the platens. The frame structure has upright post members between and along which the upper platen is slidably mounted for the rectilinear reciprocal movement toward and away from the lower platen. The yieldable reciprocal support mechanisms are stretchable to permit downward movement of the upper platen and are also retractable to cause return movement of the upper platen to an upper home position.

9 Claims, 2 Drawing Sheets

MANUAL REFUSE COMPACTOR APPARATUS HAVING PARALLEL CRUSHING PLATENS

This application is a continuation of application Ser. No. 07/788,251, filed Nov. 5, 1991 now abandoned.

BACKGROUND OF THE INVENTION

1. Field of the Invention

The present invention generally relates recycling of refuse and, more particularly, is concerned with a manually-operated refuse compactor apparatus employing parallel crushing platens.

2. Description of the Prior Art

In recent years, there has been growing interest in recycling much of the ordinary household refuse as an alternative to its disposal in landfills. The effective recycling of merely a few types of household items such as tin cans, beverage cans, plastic milk jugs and small cardboard boxes would take care of a large proportion of the total refuse. However, success of any recycling program depends greatly upon devising acceptable means and methods which people can use to effectively crush and compact these items to reduce the amount of space required for temporary storage and transport of them to a recycling drop off or collection location.

Many compacting devices designed to crush cans are known in the prior patent art. Representative examples of prior art can crushing devices are disclosed in U.S. Pat. No. 4,212,242 to Willis, U.S. Pat. No. 4,333,397 to Modes, U.S. Pat. No. 4,561,351 to Ader, and U.S. Pat. No. 4,606,266 to Hyman, Sr. While these prior art devices may function reasonably well in carrying out the applications for which they were designed, they were designed for compacting too limited a range of products, namely, cylindrical cans of various sizes. Therefore, these devices fail to accommodate a sufficiently wide range of household items, such as described above, in order to provide a sufficiently effective and versatile means for compacting items for recycling.

Automatic trash compactors capable of compacting a wide variety of typical household items are known in the prior art. However, many people find purchase of these devices difficult to justify in view of their high cost, considering that the devices are merely going to be used for the purpose of reducing the size of items to be discarded.

Consequently, a need exists for a device which is designed more appropriately and cost-effectively in light of its intended use while still being easy to operate and effective in carrying out its intended function.

SUMMARY OF THE INVENTION

The present invention provides a refuse compactor apparatus designed to satisfy the aforementioned needs. The manually-operated refuse compactor apparatus of the present invention is low in cost, simple in construction, easy to operate, and effective in carrying out its intended function.

Accordingly, the present invention is directed to a refuse compactor apparatus which comprises: (a) a frame structure; (b) a lower platen stationarily supported on the frame structure; (c) an upper platen; (d) means for mounting the upper platen to the frame structure above and in alignment with the lower platen and extending in generally parallel relation thereto and for guiding the upper platen to undergo rectilinear reciprocal movement along the frame structure toward and away from the lower platen; and (e) means attached to the frame structure for yieldably supporting the upper platen from the frame structure to permit the upper platen to undergo the reciprocal rectilinear movement toward and away from the lower platen for crushing items between the platens.

The frame structure includes a generally horizontal lower frame portion, a generally horizontal upper frame portion, and a plurality of horizontally displaced upright post members rigidly interconnecting the lower and upper frame portions and spacing the upper frame portion above the lower frame portion. The mounting and guiding means includes a plurality of spaced apart elements in the form of indentations defined in the peripheral edge of the upper platen and a plurality of guide elements in the form of surfaces defined on at least some of the upright post members of the frame structure. These upright post members are fitted with and extend generally perpendicular through the indentations such that upper platen is restricted by the guide surfaces of the upright post members to undergoing vertical rectilinear reciprocal movement toward and away from the lower platen.

The yieldable supporting means includes a pair of spring-loaded reciprocable support mechanisms being stretchable to permit downward movement of the upper platen and retractable to permit upward return movement of the upper platen to a stationary upper home position. Each of the spring-loaded support mechanisms includes a resiliently extendable and retractable spring and a bracket attached at an upper end to the spring and at a lower end to one of the opposite end portions of the upper platen.

Two of the plurality of upright post members of the frame structure support the respective spring-loaded support mechanisms. These two post members are positioned at respective opposite ends of the frame structure and of the upper platen and approximately midway between the opposite sides of the frame structure and of the upper platen and extend between the lower and upper portions of the frame structure. Also, these two upright post members contain respective vertical slots facing toward one another. The lower ends of the respective brackets which are connected to the opposite ends of the upper platen extend through the slots and slide therealong as the upper platen moves in reciprocal rectilinear fashion along the frame structure toward and away from the lower platen.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
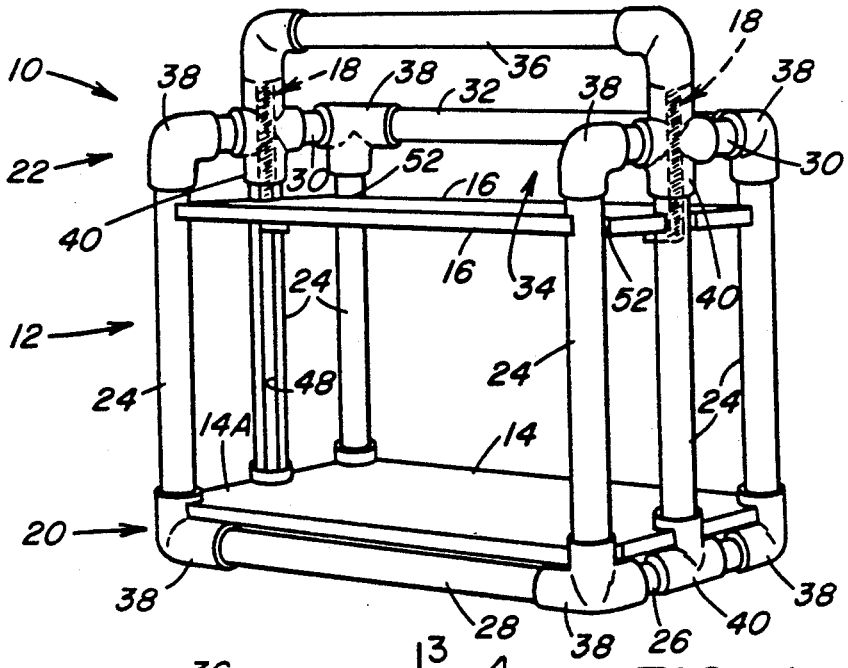
FIG. 1 is a perspective view of a manually-operated refuse compactor apparatus in accordance with the principles of the present invention.
Figure 2:
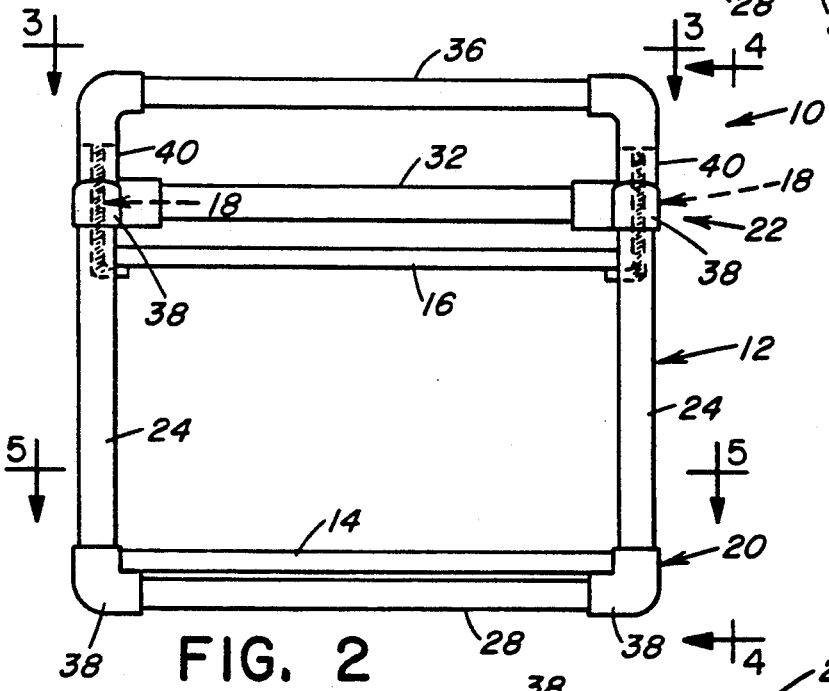
FIG. 2 is a front elevational view of the refuse compactor apparatus of FIG. 1.
Figure 3:
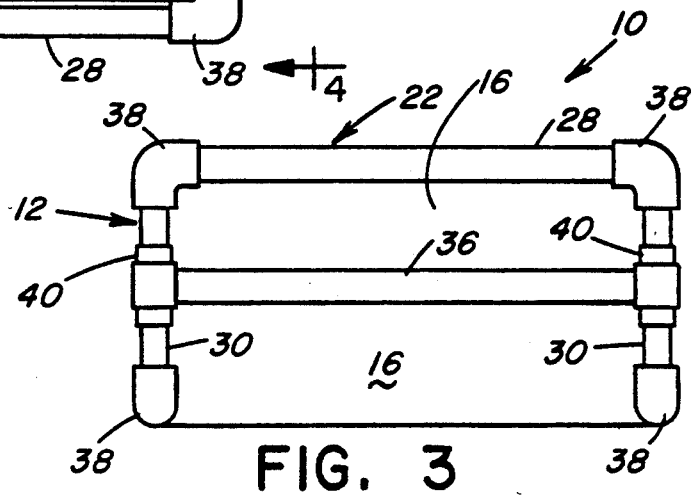
FIG. 3 is a top plan view of the refuse compactor apparatus as seen along line 3—3 of FIG. 2.

Referring to the drawings and particularly to FIG. 1, there is illustrated a manually-operated refuse compactor apparatus of the present invention, being generally designated 10. Basically, the refuse compactor apparatus 10 includes an open frame structure 12, a pair of lower and upper platens 14, 16, and means 18 for yieldably supporting the upper platen 16 from the frame structure 12 above the lower platen 14 to undergo vertical rectilinear reciprocal movement toward and away from the lower platen 14.

Referring to FIGS. 1-5, the frame structure 12 of the refuse compactor apparatus 10 includes a generally horizontal lower frame portion 20, a generally horizontal upper frame portion 22, and a plurality of upright post members 24 horizontally spaced from one another and interconnecting the lower and upper frame portions 20, 22 and spacing the upper frame portion 22 above the lower frame portion 20. The lower frame portion 20 includes a pair of lower end rail members 26 spaced from one another and a pair of lower side rail members 28 spaced from one another and extending between and connected with the lower end rail members 26. The upper frame portion 22 includes a pair of upper end rail members 30 spaced from one another and a single upper side rail member 32 extending at the same one of the opposite ends of the upper end rail members 30.

The other of the opposite ends of the upper end rail members 30 are not connected so as to provide a space or clearance 34 which is necessary for a user to be able to insert a foot to operate the refuse compactor apparatus 10. An inverted U-shaped handle 36 extends between and is connected to the upper end rail members 30 midway between the opposite ends thereof. The presence of the inverted U-shaped handle 36 also accommodates the insertion of the user's foot above the upper platen 16.

There are a total of six upright post members 24 interconnecting the lower and upper frame portions 20, 22. Four of the upright post members 24 are positioned at the respective corners thereof. The two remaining upright post members 24 are positioned between the lower and upper end rail members 26, 30 approximately midway between the opposite ends of the lower and upper side rail members 28, 32 of the frame structure 12.

In an exemplary embodiment shown in FIGS. 1-5, the respective end rail members 26, 30 and side rail members 28, 32 of the lower and upper frame portions 20, 22 and the upright post members 24 are composed of straight sections of tubing. The lower end and side rail members 26, 28 and upper end and side rail members 30, 32 are connected by elbow connectors 38 which interfit with the straight sections of tubing. The upright post members 24 and lower and upper end rail members 26, 30 are connected by T-shaped connectors 40 which interfit with the straight sections of tubing. The illustrated tubing sections and connectors are composed of a suitable extruded plastic, such as PVC. Alternatively, components of the frame structure 12 can be fabricated of a suitable molded plastic.

Figure 7:
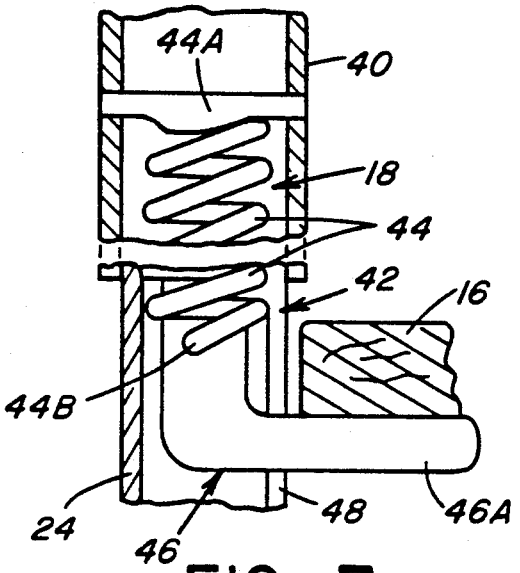
FIG. 7 is an enlarged fragmentary sectional view of the refuse compactor apparatus taken along line 5—5 of FIG. 4, showing one of a pair of spring-loaded reciprocal support mechanisms of the apparatus.
Figure 4:
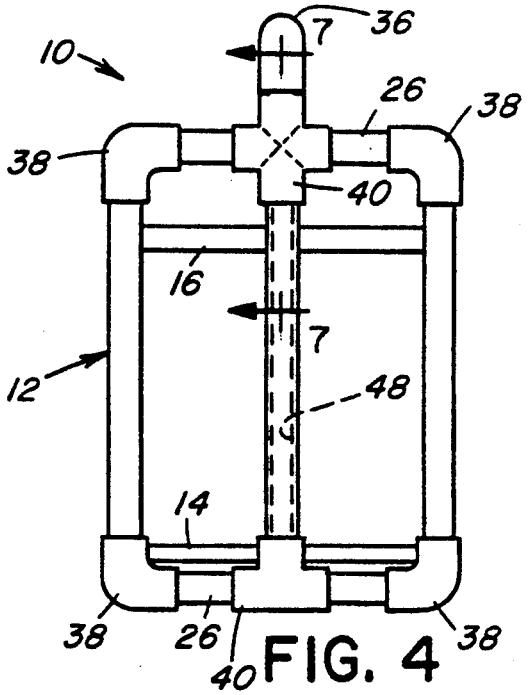
FIG. 4 is an end elevational view of the refuse compactor apparatus as seen along line 4—4 of FIG. 2.
Figure 5:
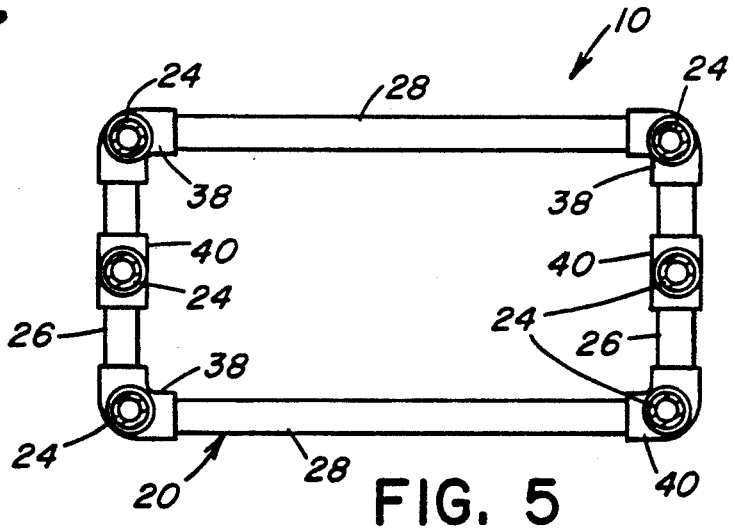
FIG. 5 is a cross-sectional view of the refuse compactor apparatus taken along line 5—5 of FIG. 2, showing a lower portion of a frame structure of the apparatus with a lower platen of the apparatus removed.
Figure 6:
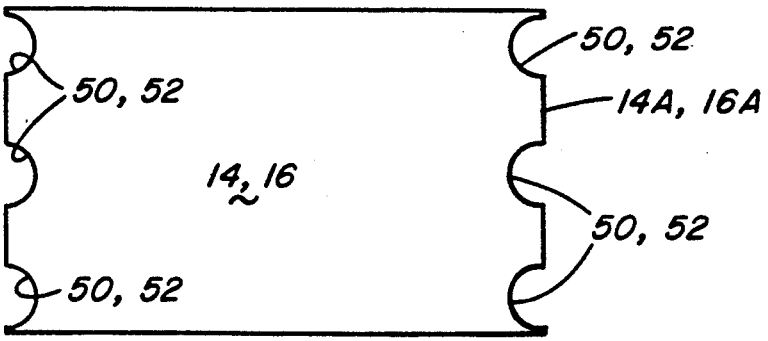
FIG. 6 is a plan view of one of the identical lower and upper platens of the refuse compactor apparatus.

Referring to FIGS. 1, 4 and 7, the yieldable supporting means 18 includes a pair of spring-loaded reciprocal mechanisms 42 being stretchable to permit downward movement of the upper platen 16 and retractable to permit automatic return of the upper platen 16 to a stationary upper home position. The yieldable supporting means 18 includes a pair of spring-loaded reciprocable support mechanisms 42 being stretchable to permit downward movement of the upper platen 16 and retractable to permit upward return movement of the upper platen 16 to a stationary upper home position. Each of the spring-loaded support mechanisms 42 includes a resiliently extendable and retractable spring 44 and a bracket 46 attached at an upper end 44A to the spring 44 and at a lower end 44B to one of the opposite ends of the upper platen 16.

The two upright post members 24 of the frame structure 12 extending between the middles of the lower and upper end rails 26, 30 of the frame structure 12 support the respective spring-loaded support mechanisms 42. At interior sides, these two upright post members 24 contain respective vertical slots 48 facing toward one another. The lower ends 46A of the brackets 46 connected to the opposite ends of the upper platen 16 extend through the vertical slots 46 and slide therealong as the upper platen 16 moves in a reciprocal rectilinear fashion along the frame structure 12 toward and away from the lower platen 14.

Referring to FIGS. 1-6, the lower and upper platens 14, 16 of the refuse compactor apparatus 10 are preferably planar plates. They can be fabricated of any suitable material, such as wood, metal or plastic. Pluralities of complementary guide elements are defined by semi-circular cutouts or indentations 50, 52 in the peripheral edges 14A, 16A of the lower and upper platens 14, 16 and by semi-cylindrical surfaces 24A on the upright post members 24. The complementary indentations 50 and upright post member surfaces 24A fit together so as to mount the lower platen 14 in a stationary position on the frame structure 12. The complementary indentations 52 and upright post member surfaces 24A fit together so as to mount the upper platen 16 to the frame structure 12 above and in alignment with the lower platen 14 so that the upper platen 16 extends in a generally parallel relation to the lower platen 14 and can undergo rectilinear reciprocal movement along the frame structure 12 toward and away from the lower platen 14. More specifically, the upright post members 24 are fitted with and extend generally perpendicular through the indentations 50, 52 such that the lower plate 14 is restricted to the stationary position on the frame structure 12 wherein its peripheral edge 14A overlies and rests upon the lower end and side rail members 26, 28 of the lower frame portion 20, whereas the upper platen 16 is restricted to undergoing the above-mentioned vertical rectilinear reciprocal movement toward and away from the lower platen 14.

The refuse compactor apparatus 10 is manually operated as follows. First, items to be compacted are placed upon the lower platen 13. Second, the user's foot is inserted at the front of the apparatus 10 through the open space 34 defined by the upper frame portion 22 and handle 36 and then placed below the handle 36 in a centered position on the top surface of the upper platen 16. The upper platen 16 is then manually pressed downward by the user's foot with sufficient force to overcome the upward biasing force of the spring-loaded support mechanisms 42 and the resistance of the items on the lower platen 14 in order cause downward rectilinear movement of the upper platen 16 toward the lower platen 14 and crushing and flattening of the items between the platens 14, 16. After crushing and compacting of the items is completed, the foot of the user is raised slowly to permit the upper platen 16 to move upward automatically under the influence of the upward biasing force of the spring-loaded support mechanisms 42 and return to the stationary upper home position. The handle 36 is used to transport the refuse compactor apparatus 10.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. A refuse compactor apparatus, comprising:

(a) a frame structure including (i) a pair of generally horizontal lower and upper frame portions having respective pairs of lower and upper spaced corners located at opposite ends of said lower and upper frame portions, (ii) first and second pairs of upright corner post members horizontally spaced from one another and extending between and rigidly interconnecting said respective lower and upper spaced corners at said opposite ends of said lower and upper frame portions so as to space said upper frame portion above said lower frame portion, and (iii) first and second upright middle post members being disposed respectively between and horizontally spaced from said upright corner post members of said first and second pairs thereof, said first and second upright middle post members extending between and rigidly interconnecting said lower and upper frame portions at said opposite ends thereof;

(b) a lower platen stationarily supported by said lower frame portion of said frame structure and disposed between said upright corner and middle post members;

(c) an upper platen having a peripheral edge and being movably disposed between said lower platen and said upper frame portion of said frame structure and between said upright corner and middle post members;

(d) means located solely at least at some of said upright corner and middle post members and solely along said peripheral edge of said upper platen for coupling said upper platen solely to said some upright corner and middle post members of said frame structure above and in alignment with said lower platen and extending in generally parallel relation to said lower platen and for guiding said upper platen to undergo rectilinear reciprocal movement along said upright corner and middle post members of said frame structure toward and away from said lower platen;

(e) means attached solely to at least some of said upright corner and middle post members of said frame structure and to said upper platen solely along said peripheral edge thereof and extending solely between said upper frame portion and said upper platen for yieldably supporting said upper platen from thereabove and solely from said some of said upright corner and middle post members of said frame structure so as to permit said upper platen to undergo said reciprocal rectilinear movement from a stationary upper home position toward and away from said lower platen for crushing items between said platens; and (f) a handle member spaced above said upper frame portion and extending between and connected at opposite ends to said upper frame portion above said upright middle post members so as to provide sufficient space between said upper platen and said handle member to accommodate insertion of a user×s foot above the platen for stepping thereon to cause rectilinear movement of said upper platen toward said lower platen to crush items therebetween.

2. The apparatus of claim 1 wherein said yieldable supporting means includes a pair of spring-loaded reciprocable support mechanisms respectively mounted solely to said upright middle post members and extending above said upper platen to said upper frame portion, said spring-loaded reciprocable support mechanisms being stretchable to permit downward movement of said upper platen due to the imposition of a downward force thereon by the user's foot and retractable to permit upwardly return movement of said upper platen to said stationary upper home position upon release thereof by the user's foot.

3. The apparatus of claim 2 wherein each of said spring-loaded support mechanisms includes:

a resiliently extendable and retractable spring; and a bracket attached at an upper end to said spring and at a lower end to an end of said upper platen.

4. The apparatus of claim 1 wherein lower frame portion includes a pair of lower end rail members spaced from one another and a pair of lower side rail members spaced from one another and extending between and rigidly connected with said lower end rail members.

5. The apparatus of claim 1 wherein said upper frame portion includes a pair of upper end rail members spaced from one another and a single upper side rail member extending between and rigidly connected with said upper end rial members.

6. The apparatus of claim 1 wherein said coupling means includes:

a plurality of first guide elements located solely along said peripheral edge of said upper platen; and a plurality of second guide elements located at said some upright post members of said frame structure, said first and second guide elements being fitted together so as to guide said upper platen along said upright post members in undergoing said vertical rectilinear reciprocal movement toward and away from said lower platen.

7. The apparatus of claim 6 wherein:

said first guide elements are indentations in said peripheral edge of said upper platen; and said second guide elements are portions of respective exterior surfaces of said some upright post members;

said upright post members being fitted with and extend generally perpendicularly through said indentations such that said upper platen is substantially restricted by said upright post members to undergoing said rectilinear reciprocal movement toward and away from said lower platen.

8. The apparatus of claim 3 wherein said upright middle post members contain respective vertical slots facing toward one another, said lower ends of said respective brackets, which are connected to said opposite ends of said upper platen, extend through said slots and slide therealong as said upper platen moves in reciprocal rectilinear fashion along said frame structure toward and away from said lower platen.

9. The apparatus of claim 1 wherein said handle member is substantially aligned with said upright middle post members.

* * * * *